US006863420B1

(12) United States Patent
Schütz

(10) Patent No.: US 6,863,420 B1
(45) Date of Patent: Mar. 8, 2005

(54) ANTI-DAZZLING TRANSPARENT SCREEN FOR ILLUMINANTS

(75) Inventor: Ottokar Schütz, Villingen-Schwenningen (DE)

(73) Assignee: LID Light Design, Villingen-Schwenningen (DE)

( * ) Notice: Subject to any disclaimer, the term of this patent is extended or adjusted under 35 U.S.C. 154(b) by 0 days.

(21) Appl. No.: 10/130,630

(22) PCT Filed: Nov. 16, 2000

(86) PCT No.: PCT/EP00/11345

§ 371 (c)(1), (2), (4) Date: May 17, 2002

(87) PCT Pub. No.: WO01/36867

PCT Pub. Date: May 25, 2001

(30) Foreign Application Priority Data

Nov. 18, 1999 (DE) ..... 199 55 435

(51) Int. Cl.[7] ..... F21V 5/02

(52) U.S. Cl. ..... 362/340; 362/224; 362/327

(58) Field of Search ..... 362/223, 224, 362/327, 330, 332, 335–340

(56) References Cited

U.S. PATENT DOCUMENTS

| | | | | | |
|---|---|---|---|---|---|
| 1,941,079 | A | * | 12/1933 | Exelmans | 362/224 |
| 2,356,654 | A | * | 8/1944 | Cullman | 362/223 |
| 3,278,743 | A | * | 10/1966 | Franck | 362/339 |
| 4,450,509 | A | * | 5/1984 | Henry | 362/223 |
| 4,660,131 | A | * | 4/1987 | Herst et al. | 362/223 |
| 6,151,169 | A | * | 11/2000 | Kim | 362/339 |

* cited by examiner

*Primary Examiner*—Alan Cariaso
(74) *Attorney, Agent, or Firm*—Gudrun E. Huckett

(57) ABSTRACT

An anti-dazzling transparent screen for elongate illuminant bodies which covers the illuminant body over the length thereof for the purpose of anti-dazzling of a radiating sector of the illuminant body, has a surface formed by elongate prisms extending approximately parallel to one another and aligned substantially along the illuminant body. The prisms are positioned relative to the illuminant body such that on at least one of the prism surfaces a total reflection of the light beams, having entered the respective prism and impinging on this prism surface, occurs.

11 Claims, 8 Drawing Sheets

ANTI-DAZZLING TRANSPARENT SCREEN FOR ILLUMINANTS

BACKGROUND OF THE INVENTION

1. Field of the Invention

The invention relates to an anti-dazzling transparent screen for elongate illuminant bodies which covers the illuminant body over the length thereof for the purpose of providing an anti-dazzling effect of a radiating sector of the illuminant body, wherein the surface of the transparent screen in formed by elongate prisms extending approximately parallel to one another and aligned substantially along the illuminant body.

2. Description of the Related Art

In the illumination of rooms, in particular, in the case of office illumination with the usually required high luminance, the light source is to be provided with anti-dazzling properties relative to the position of a work space such that no disturbance caused by glare occurs in the field of view of the worker when viewing the work assignment. In order to provide a comfortable room illumination, measures are required to change the luminance produced by the light source and observed by the worker. In particular, in office work spaces which are furnished with monitors, direct glare and reflective glare are to be prevented. Direct glare occurs when great brightness is generated in the field of sight, for example, when viewing the work surface, for example, the monitor or paperwork. In principle, a direct viewing of the illuminant body is to be prevented. In the case of elongate illuminant bodies anti-dazzling measures in the transverse direction, partially also in the longitudinal direction, of the illuminant body are known wherein the radiating angle of the illuminant body is realized by downwardly extended housing walls of a housing in which the illuminant body is received. Those work spaces which are outside of the radiating sector of the illuminant body are glare-free.

For providing an anti-dazzling effect of the illuminant body within the radiating sector, anti-dazzling transparent screens are known which are comprised of light-transmissive material and cover the illuminant body over the length thereof. From DE 34 20 414 C2 a light-transmissive lamp cover for providing an anti-glare effect of lighting devices with elongate lamps and a reflector arranged above the lamp is known which covers the reflector opening and is provided with elongate prisms, designed to scatter the light passing through, on the side facing away from the lamp. The elongate prisms are positioned approximately parallel to one another and extend transverse to the longitudinal axis of the lamp, wherein in this way, taking into account the refractive index of the material of the anti-dazzling transparent screen, the radiating angle of the illuminant body along the axis of the lamp is to be limited. The prism cross-section has the shape of an isosceles triangle, and the shape of the prism cross-section must be selected such that a total reflection is prevented in order to thus affect the light distribution of the lighting device transverse to the lamp axis as little as possible. In this way, the illuminant body is pictured on the visible surface of the anti-dazzling transparent screen wherein the very bright image of the illuminant body is often perceived as disturbing. In this connection, the observed luminance is between 80% to 100% of the luminance of the light source, measured in the field of sight of a viewer, in particular, when in a seated position. An anti-glare effect of the illuminant body in the transverse direction is not attempted with the known arrangement.

From DE 41 15 836 A1 a lighting device with a rod-shaped, horizontally arranged light source is known which, for the purpose of providing an anti-glare effect, is surrounded by a prism foil. The prisms are arranged parallel and adjacent to one another and extend parallel to the longitudinal axis of the housing. On the foil which is arranged concentrically to the rod-shaped light source, the prisms are formed as isosceles triangles and arranged symmetrically wherein a transparent protective tube is positioned about the cylindrical prism body. The light beams which are radially emitted by the rod-shaped lamp and the immediate neighboring beams penetrate into the respective prism approximately perpendicularly to the prism base and are reflected on the prism surfaces which are the legs of the rectangular prism cross-section. In this way, the radial beams which are the most intensive ones of all radiated light beams are reflected back into the light source and are absorbed therein so that an antilare effect can be achieved with this known arrangement only with an enormous loss of light.

DE 197 45 844 A1 discloses the use of prism foils for the light emission opening of a reflector. In this connection, the reflector and prism foil surround the illuminant body. The prism contour is essentially a planar surface having arranged at one side the ribs of the actual prism structure. The longitudinal axis of the prisms is perpendicular to the lamp axis. In order to obtain a wide radiating (inner light of a vehicle) or a directed (signal light of a vehicle) light distribution, the reflector is to be dimensioned such that the reflector and the prism foil form an integral unit.

SUMMARY OF THE INVENTION

The present invention has the object to further develop the anti-dazzling screen of the aforementioned kind such that a completely glare-free room illumination is provided which gives a uniform room impression and provides a light intensity as high as possible.

This object is solved according to the invention in that the prisms are positioned relative to the illuminant body such that on at least one of the prism surfaces a total reflection of the light beams, having entered the respective prism and impinging on this prism surface, occurs.

According to the invention, a uniform light radiation from the anti-dazzling transparent screen is achieved by an arrangement of the prisms relative to the illuminant body such that an on at least one of the prism surfaces the light beams impinging thereon are totally reflected. The anti-dazzling transparent screen is penetrated by some of the light beams entering the prisms while the other light beam bundles are reflected back by total reflection. In this way, the beam bundle radiated radially onto the prisms by the light source is scattered. As a result of the orientation of the prisms along the illumination body, particularly the lateral areas of the illuminant body also achieve a complete anti-glare effect and the room is uniformly illuminated. The prisms must be arranged in accordance with their cross-sectional sectional shape and the refractive index of the material relative to the illuminant body such that by total reflection on a prism surface partial bundles of the impinging light beams are prevented from direct penetration of the transparent screen.

Expediently, the side of the anti-dazzling transparent screen facing the illuminant body is formed of the substantially planar base surfaces of the prisms wherein the total reflection on one of the prism surfaces is realized on the side of the transparent screen remote from the illuminant body. The total-reflected light beams are prevented from exiting the prisms on the remote side of the illuminant body. In a preferred embodiment of the invention the transparent screen is comprised of a prism foil with a prismatic surface on one side which is arranged in front of the illuminant body so as to cover the illuminant body. According to the cross-sectional shape of the prism, i.e., the width of the base surfaces and the angular alignment of the projecting prism surfaces on the prismatic surface, the prism foil is to be positioned at such a distance from the illuminant body that the desired total reflection on the prism surfaces is obtained. With a suitable curvature of the prism foil about the illuminant body, the prisms can be positioned in a simple way in the desired position. Advantageously, the prisms have a triangular cross-section wherein the base surface of the prisms corresponds to the base of the triangular cross-section and is facing the illuminant body. In this connection, the portion of the light bundle entering through the base surface and impinging on one of the lateral side surfaces of the prism is total-reflected while the portion of the light bundle impinging on the other lateral side surfaces of the triangular prism passes through the anti-dazzling transparent screen and is deflected. The lateral side surfaces correspond to the triangle sides of the prism cross-section which are positioned at an angle to the base surface.

Particularly advantageously, the prisms have the shape of an isosceles triangle wherein the curvature of the prism foil allows the adjustment of the radiating angle of the anti-dazzling transparent screen as needed. In this connection, it is considered to be advantageous when the total-reflected light beams are reflected back adjacent to the axis of the illuminant body. The prisms with the cross-sectional shape of an isosceles triangle can be moved by a suitable curvature simply into a desired position in which on one of the cathetus surfaces a total reflection results when the base surfaces of the individual prisms are positioned at an angle deviating from 90° relative to the light beams impinging on the prism.

BRIEF DESCRIPTION OF THE DRAWINGS

Embodiments of the invention will be explained in the following with the aid of the drawings. It is shown in.

DESCRIPTION OF PREFERRED EMBODIMENTS

Figure 1:
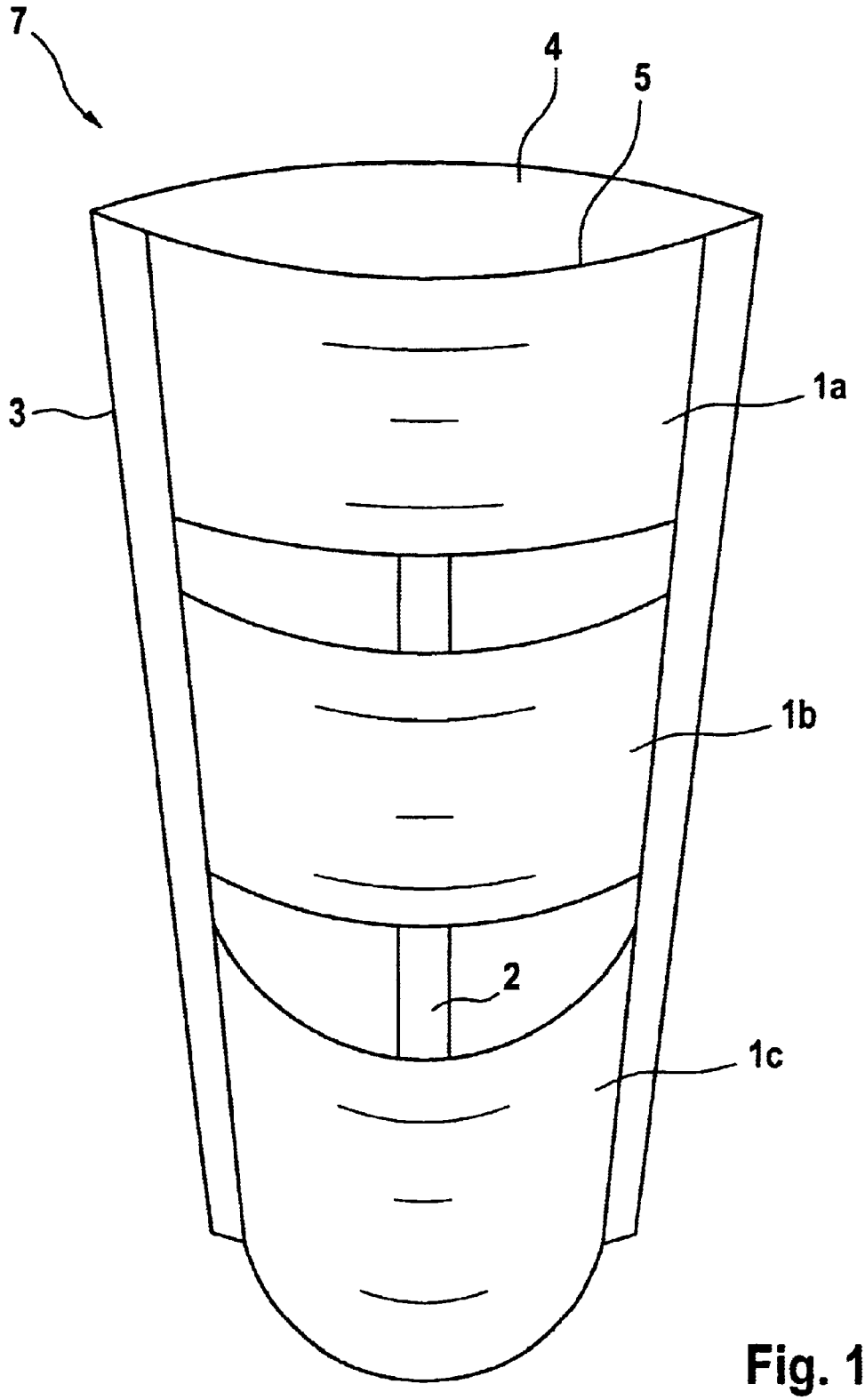
FIG. 1 a view of the lighting device with an anti-dazzling transparent screen according to the invention.

FIG. 1 shows a perspective view of the lighting device 7 which, for the purpose of illuminating a room, is attached preferably to the ceiling. The lighting device 7 comprises a housing 3 in which an elongate illuminant body 2 is arranged. On the open side of the housing 3 facing the room to be illuminated, a prism foil 1*a*, 1*b*, 1*c* is arranged which covers the illuminant body 2 over the entire length thereof. The prism foil is comprised of light-transparent material and has at the visible side, i.e., the side facing away from the illuminant body 2, a prismatic surface. The prismatic surface is formed by continuous prisms which are arranged parallel to the longitudinal direction of the illuminant body 2 adjacent to one another which scatter the light bundle entering at the inwardly positioned side of the foil. The anti-dazzling effect of the prism foil is determined by the relative position of the respective prism cross-sections which is variable by means of the radius of curvature of the prism foils 1*a*, 1*b*, 1*c*. In particular in the case of prism foils with symmetric prism cross-section, like the triangular cross-sections with isosceles triangles in the present case, by means of the radius of curvature about the illuminant body 2 the desired anti-dazzling effect can be individually adjusted to the spatial conditions of the room to be illuminated. The optical effect of the prism foil for anti-dazzling effects of the illuminant body 2 will be explained in more detail infra. In FIG. 1 different radii of curvature 1*a*, 1*b*, 1*c* are illustrated in an exemplary fashion wherein expediently the curvature of the prism foil remains constant across the entire length of the illuminant body 2. The prism foil rests against a curved edge 5 of the end face walls 4 of the lighting device housing 3 wherein the contour of the curved edge 5 determines the radius of curvature of the foil. The prism foil can also be flush or recessed relative to the respective end face wall 4. The flat curvature identified at 1*a* has a flat light distribution curve which has a reduced luminosity approximately between 60° and 80° to the vertical of the illuminant body. A medial curvature of the prism foil 1*b* results in a light distribution curve which emits no light approximately between 60° and 90° to the vertical. With the protruding outer geometry of the prism foil 1*c* the luminance in the light distribution curve is minimal in the angle range between approximately 75° and 90° to the vertical.

Figure 2:
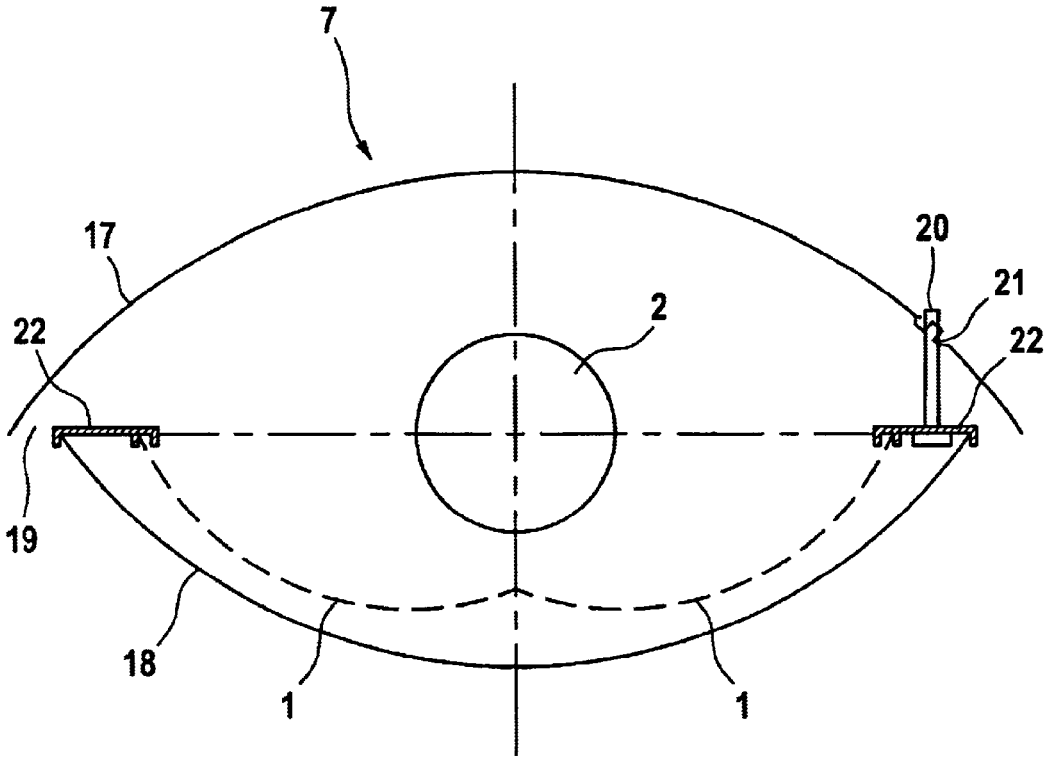
FIG. 2 a cross-section of a lighting device with an anti-dazzling transparent screen according to the invention.

FIG. 2 shows a cross-section of a lighting device housing 3 with a prism foil 1 for anti-glare effects for the elongate illuminant body 2. The prism foil 1 covers the radiating sector of the illuminant body 2 into the room to be illuminated by approximately 180°. The prism foil 1 in the present embodiment of the lighting device 7 is surrounded by a housing bottom 18 which can be highly transparent or of a textured configuration in order to obtain optical illumination effects. The lateral edges of the prism foil 1 and of the housing bottom 18 extending parallel to the longitudinal axis of the illuminant body 2 are engaged by a housing carrier 22. The housing carrier 22 comprises two profiled rails which extend approximately parallel to one another on both sides of the illuminant body 2 and receive the edges of the prism foil 1. The prism foil 1 is secured with such a width in the housing carrier 22 that a curved course of the prisms about the illuminant body 2 results. The anti-dazzling effect of the curvature of the prism foil 1 will be explained in more detail infra. Expediently, the prism foil, as illustrated in the present embodiment, is approximately mirror-symmetrically arranged relative to a diameter axis of the illuminant body 2 which extends perpendicularly to the transverse axis between the housing carriers 22.

The housing carriers 22 are provided at the top side, i.e., the side remote from the prism foil 1, with spacer elements 20 which support a housing cover 17. The housing cover 17 is transparent. The housing cover 17, the housing carriers 22, and the housing bottom 18 with the prism foil 1 arranged therein are arranged relative to one another such that between the housing cover 17 and the housing bottom 18 an air gap 19 is formed. Air can be exchanged through the air gap 19 between the housing interior and the surroundings of the lighting device 7 wherein the air can circulate without particles being able to drop from the top into the housing gap 19. Across the length of the lighting device 7, several spacer elements 20 are provided on which the housing cover 17 is fastened by means of clamps 21 or the like. The right side of the drawing shows a section at the level of a spacer element 20 while on the left side a section arranged on a transverse plane of the lighting device 7 positioned between two spacer elements 20 is illustrated wherein the air gap 19 is clearly shown.

The FIGS. 3 to 6 show the refraction conditions of the light beams on the prisms in an exemplary fashion for an individually illustrated prism. The prism foil is arranged such that the base surface 8 corresponding to the base of the triangular cross-section faces the illuminant body 2. In the present case the lateral side surfaces 11, 12 of the isosceles triangular cross-section of the prism are positioned at an angle of 45° relative to the base surface 8 wherein, taking into account the spacing of the prism 10 to the illuminant body 2, the desired total reflection on one of the lateral side surfaces 11, 12 occurs in a certain range of the angle of incidence of the base surface 8 to the radial lines of the illuminant body 2. Each prism of the prism foil is positioned at such an angle position to the illuminant body 2 that the light beams 13 in the radiating sector $\Delta\epsilon$ of the illuminant body 2 enter at an angle deviating from 90° through the base surface 8 into the prism 10. For a flat angle of the base surface 8 to the emitted light bundle 13 in the radiating sector $\Delta\epsilon$ according to FIG. 3 the light bundle 16 impinging on the upper lateral side surface 12 is refracted on the lateral side surface 12 upon exiting the prism and is radiated into the room to be illuminated. The portion of the light beams 13 radially radiating from the illuminant body 2 and impinging on the lower lateral side surface 11 is total-reflected upon impinging on the lateral side surface 11 wherein the reflected light bundle 14, with refraction on the second lateral side surface 12, exits approximately in perpendicular directions relative to the radiating sector $\Delta\epsilon$. The angle of incidence of the prism 10 or of the base surface 8 to the illuminant body 2 is in the present case approximately 15°. It is apparent that the invention, residing in that the light bundle within the prism is allowed to exit partially with deflection while being partially reflected with total reflection on a prism surface, can also be realized with other prism cross-sections than that of an isosceles triangle. For example, a triangle cross-section with different lateral side angles could be selected wherein also an exact perpendicular alignment of the base to the illuminant body 2 would be possible. Also, other prism cross-sections are conceivable such as, for example, a trapezoidal cross-section or the like, wherein total reflection occurs on one prism surface as a result of the prism structure and prism position.

Figure 3:
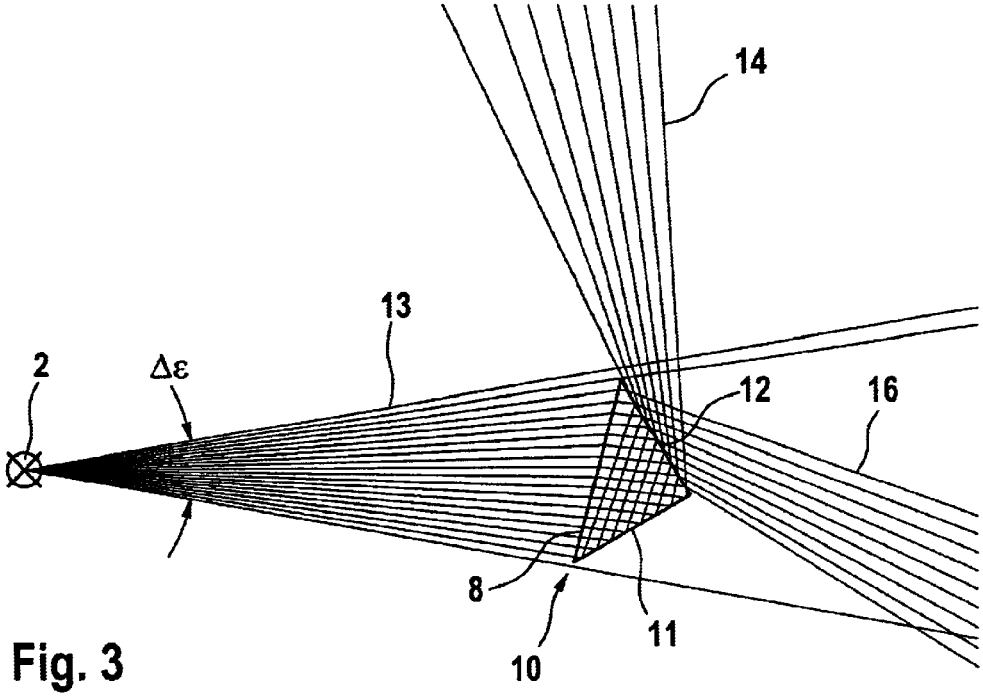
FIG. 3–FIG. 6 beam paths for a single prism showing different angle positions of the prism cross-section relative to the illuminant body.
Figure 4:
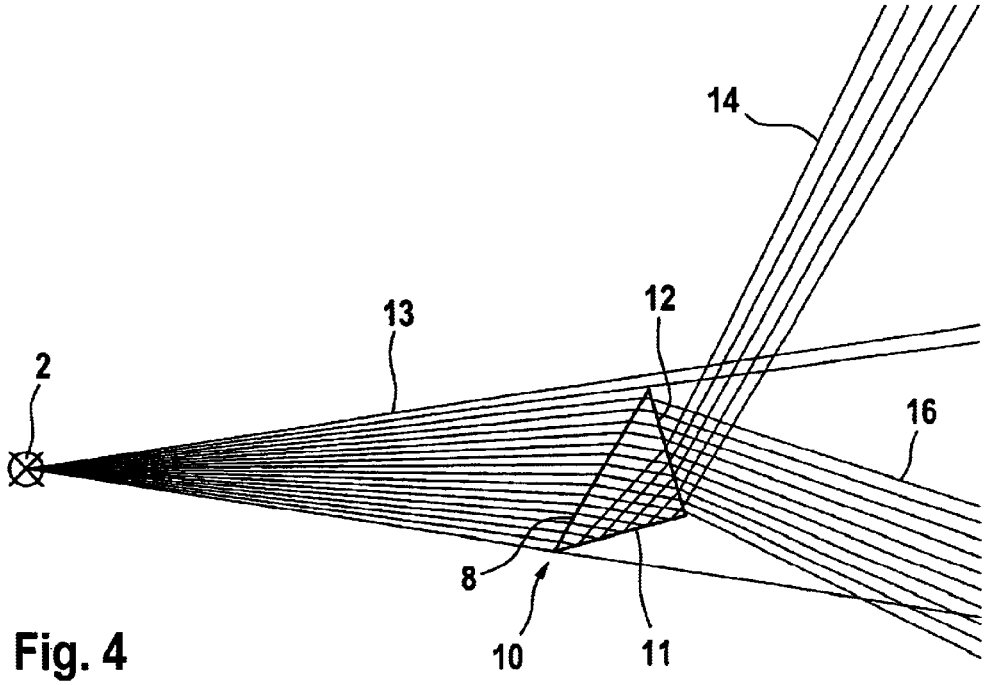

FIG. 4 shows a prism 10 of the same geometry as that in FIG. 3 in a position with greater angle of incidence relative to the illuminant body 2, in the present case approximately 30°. This illustrates that the light beams 16 which are refracted at the upper lateral side surface 12 and penetrate the lateral side surface 12 are radiated in approximately the same direction as in the case of the reduced angle position of the prism 10 according to FIG. 3. By means of the angle position of the prism 10 relative to the illuminant body 2 it is thus possible for a given length of the prism base surface 8, taking into account the spacing of the prism relative to the illuminant body 2, to affect the radiating direction of the total-reflected light beams 14 which impinge on the lower lateral side surface 11 of the prism 10. By rotation of the prism in an angle range in which on the lateral side surface 11 total reflection occurs, the radiating direction of the total-reflected light beams 14 can be varied within a greater angle range than the deflection range of the light beams 16 which are only refracted upon passing through the upper lateral side surface 12. An enlargement of the angle of the prism base surface 8 results in a proportionally greater effect on the angle range of the total reflection in comparison to that of refraction up to a limit angle.

Figure 5:
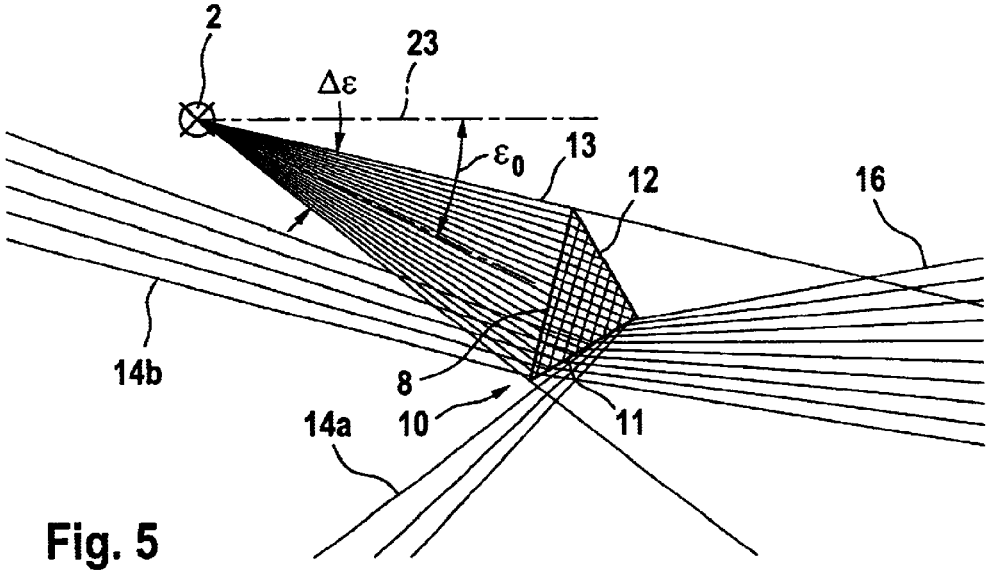

FIG. 5 shows the beam paths of a prism with triangular cross-section. Relative to the position of the prism in FIG. 4, this prism is rotated relative to the horizontal reference axis 23 about the light source 2. The radiating angle $\Delta\epsilon$ of the light bundle impinging on the base surface corresponds to that of the prism arrangement according to FIG. 4. As a result of the displaced arrangement relative to the horizontal axis 23, however, a greater average angle of incidence $\epsilon_0$ of the beam bundle onto the prism 10 is present. The slant of the base surface 8 relative to the vertical corresponds thus to that of the prism according to FIG. 4 and is approximately 30°. In this way, the light beams refracted on the base surface 8 are refracted on the lower lateral side surface 11 and are deflected when exiting the prism 10. The part of the beam bundle which impinges on the upper lateral side surface 12 undergoes total reflection and impinges subsequently on the other lateral side surface 11. As a function of the angle of incidence, either refraction and exiting of these light beams 14*a* out of the prism 10 or a further total reflection occurs, wherein these light beams 14*b* exit through the base surface 8 from the prism 10. The curvature of the prism foil about the illuminant body 2 determines the position of the individual prisms relative to the illuminant body 2 wherein, as shown by the beam paths of the prisms of same cross-section according to FIGS. 4 and 5, the desired anti-dazzling effect can be obtained by the relative position of the prisms.

The effect of the slant angle of the lateral side surfaces provided for the total reflection of the light beams in comparison to that of the base surface will be explained in the following with the aid of FIG. 6. The angle of the lateral side surface 11 relative to the base surface 8 is identified at a wherein the angles $\alpha_1$, $\alpha_2$, $\alpha_3$, $\alpha_4$, $\alpha_5$ correspond to different prism angles between lateral side surface and base. When the base surface 8 is arranged at the slant angle $\epsilon$ to the light source, a total reflection occurs on the prism surface 11 when the following in equation is fulfilled:

$$\epsilon \leqq \epsilon_{lg} := \arccos\left[\sin(\alpha)\sqrt{n^{2-1}} + \cos(\alpha)\right]$$

In the preferred angle range of the prism cross-section of $15° \leqq \alpha \leqq 75°$ the following equation derived therefrom applies:

$$\varepsilon \leq \varepsilon_{lg} := \frac{\pi}{2} + n[\alpha - \alpha_{lg}]\left\{1 + [n^2 - 1]\frac{[\alpha - \alpha_{lg}]^2}{6}\right\}$$

With the following definitions:

$\alpha$: prism angle between (left) lateral side surface of the prism and base surface $\epsilon$: angle of incidence of the light relative to the base surface slant=$\delta_q - \delta_b$ wherein $\delta_q$: the slant of the incident beam relative to the horizontal $\delta_b$: the slant of the base surface to the horizontal n: refractive index of the prism $\alpha_{tg}$: refractive angle according to the equation:

$$n \sin(\alpha_{tg})=1$$

Figure 6:
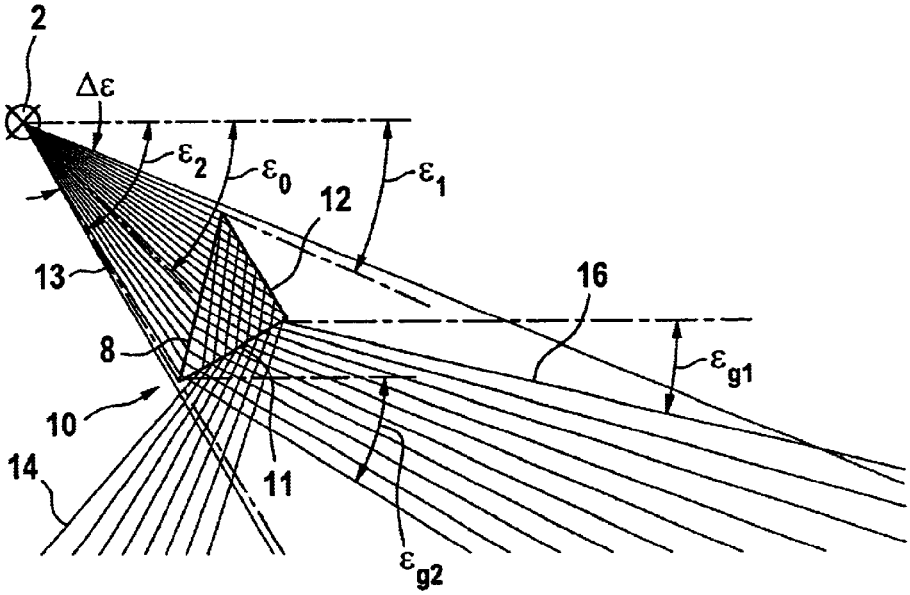

FIG. 6 shows the basic angle relations of the incident light beams on the prism and the deflection angle on a prism with an isosceles and right triangle cross-section, wherein the slant of the prism base surface to the illuminant body 2 is approximately 15°. For a ratio of the spacing between the illuminant body 2 and the prism base surface 8 and the length of the prism base 8 of approximately 1, an average incident angle of $\epsilon_0$=45° results for the illustrated prism. The radiating sector $\Delta\epsilon$ which is covered by this prism is approximately 40° between the boundary light beams impinging on the base tips according to the boundary incident angles $\epsilon_1$, and $\epsilon_2$. The light beams which impinge on the right lateral side surface 11 of the prism are refracted for direct room illumination to the visible outer side of the prism. The light deflection is carried out in an angle range between $\epsilon_{g1}$ and $\epsilon_{g2}$ of approximately 30°. The beams impinging on the left lateral surface 12 are total-reflected and subsequently refracted additionally on the right lateral surface 11, wherein the refraction takes place in a direction toward the base surface 8, i.e., the illuminated body 2. For a further extension of the spacing of the prism of the illuminant body 2, taking into account the prism geometry, a second total reflection of the light beams already reflected on the first lateral side surface can occur. As a result of the double total reflection the entire angle range of the first lateral side surface provided for total reflection is reflected back in the direction of the illuminant body 2.

Figure 7:
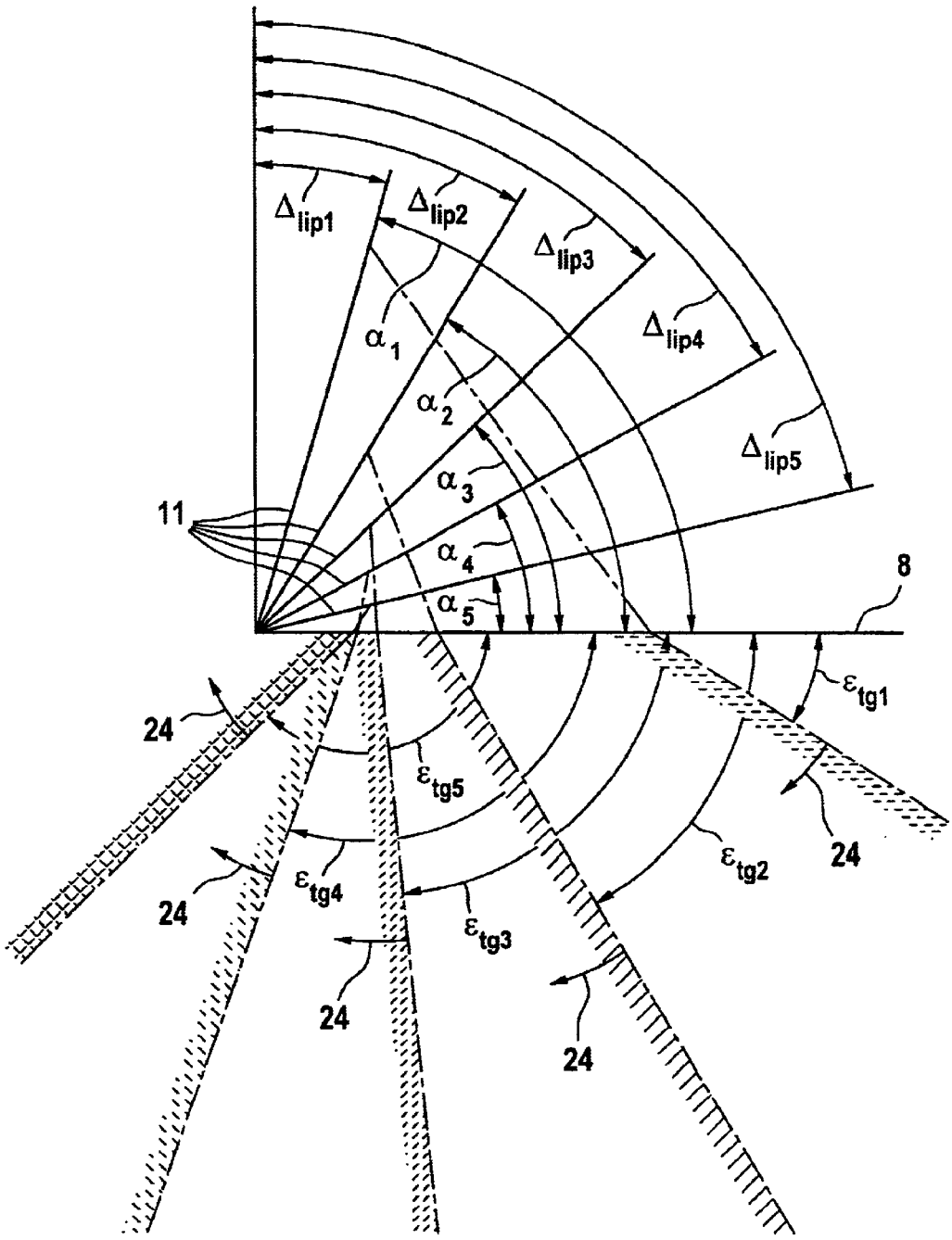
FIG. 7 an illustration of the angular relations of the beam paths.

In the illustration of FIG. 7 the prism angles $\alpha_1$ to $\alpha_5$ relative to the base surface 8 are shown. The base surface 8 is positioned approximately horizontally to simplify the illustration. The slant of the lateral side surfaces 11 is indicated as slant angles $\Delta_{tip1}$ to $\Delta_{tip5}$ relative to the vertical. The limit angle at which total reflection on the prisms results for the corresponding prism angles $\alpha$ are identified at $\epsilon_{tg1}$ to $\epsilon_{tg5}$. As soon as the angle of incidence $\epsilon$ of the light surpasses the limit angle $\epsilon_{tgi}$ with i=1 to 5, i.e., in the area within the direction of arrow 24, total reflection on the lateral side surface 11 occurs.

In the prism foil for generating anti-dazzling effects of the lighting device, the curvature of the foil is selected such that the individual prisms are slantedly arranged relative to the illuminant body so that by means of the total reflection the desired anti-glare effect or the desired light distribution curve of the illuminant body is achieved. The slants of the individual prisms can be different wherein, however, with consideration of the prism length and the respective distance to the illuminant body the angles of incidence on the lateral side surfaces within the prisms are within the angle range of total reflection. The slant angle of the prisms are increased in the circumferential direction of the prism foil about the illuminant body relative to the preceding prism, respectively. In this connection, the increase of the slant angle between the prisms can be within an angle range of 1° to 2°.

Figure 8:
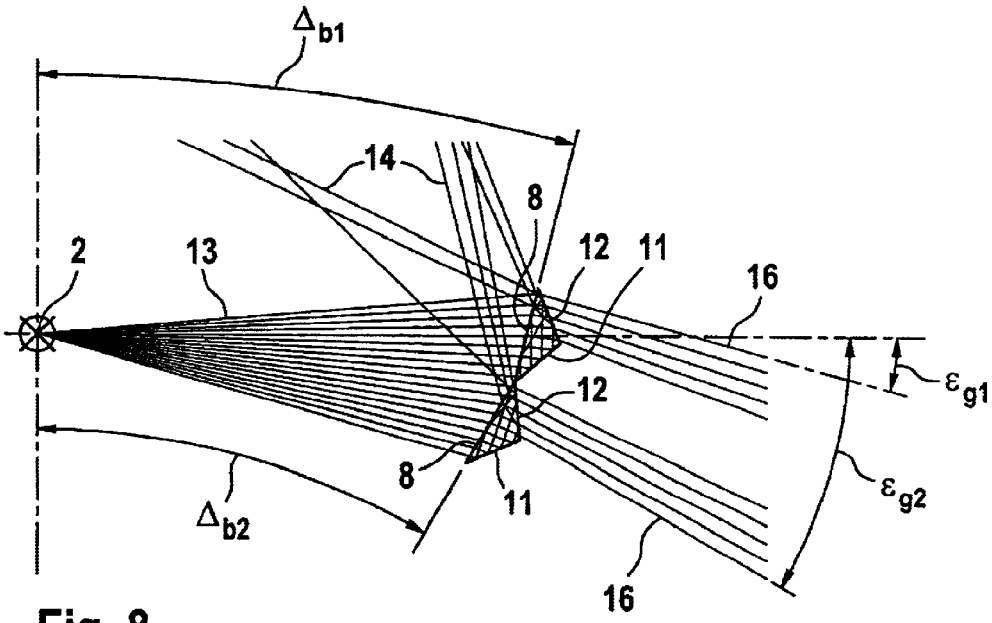
FIG. 8 an illustration of the beam paths for two neighboring prism beam paths.

FIG. 8 shows a section of a prism foil with two illustrated neighboring prisms 8 which are slanted relative to one another by approximately 15°. In this context, the slant angle of the slant surfaces 8 in the case of the upper prism are approximately $\Delta_{b1}$=15° and in the case of the lower prism 30°. The sum total of the light beams 16 penetrating the prisms which are refracted on the left lateral side surface 12 of the two prisms exit in the limit angle range between eg, $\epsilon_{g1}$=15° and $\epsilon_{g2}$=30°. The light beams 14, which are initially total-reflected on the right lateral side surface 11 and then on the left lateral side surface 12, are guided into the room to be illuminated facing away from the illuminant body 2.

Figure 9:
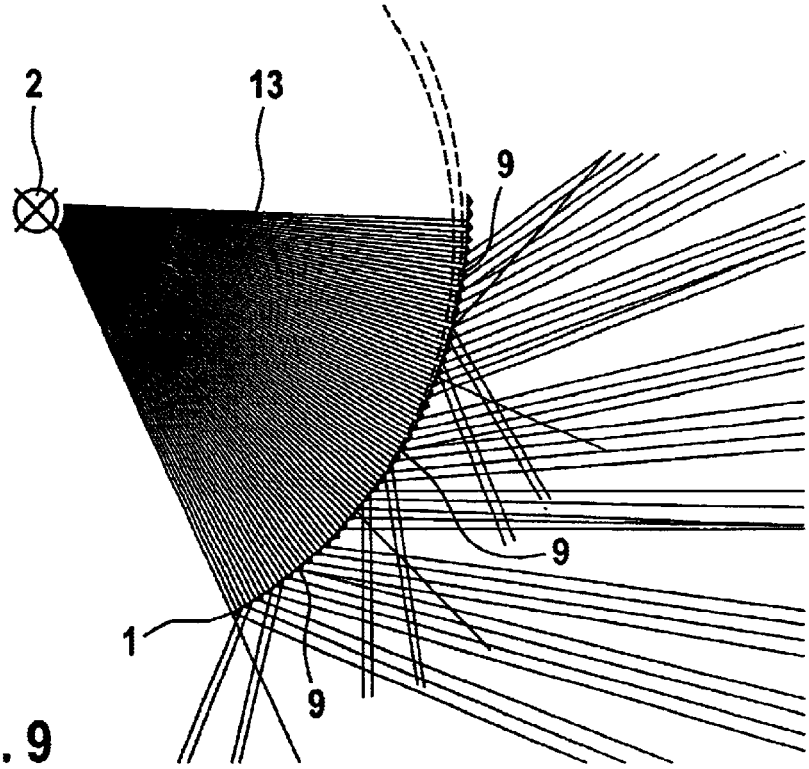
FIGS. 9 and 10 schematic illustrations for forming the transparent screen geometry for a curved foil.

An advantageous curvature contour of the prism foil in which the refraction range of the prisms is optimal, is illustrated in FIG. 9. The prism foil 1 is comprised in the circumferential direction about the illuminant body 2 of circular segments 9 with several prisms wherein the radius of curvature of the circular sectors results in an optimal widening of the radiating area, respectively, in which radiating area the incident light is reflected. The course of the prism foil geometry is formed by adjoining the circular segments 9 wherein the next circular segment 9 follows the preceding circular segment by a rotation about the axis of the illuminant body 2 such that the outer boundary beam of the adjoined circular segment contour is congruent as much as possible with the inner boundary beam of the preceding circular segment contour. In this way, adjacently positioned circular segments are obtained which have a common tangent at a common point of intersection. Taking into account the prism geometry and the spacing corresponding to the optimal radius of curvature, a light refraction is provided in each circular segment which leads to the optimal light distribution curve and light scattering for the anti-glare effect of the lamp 2.

Figure 10:
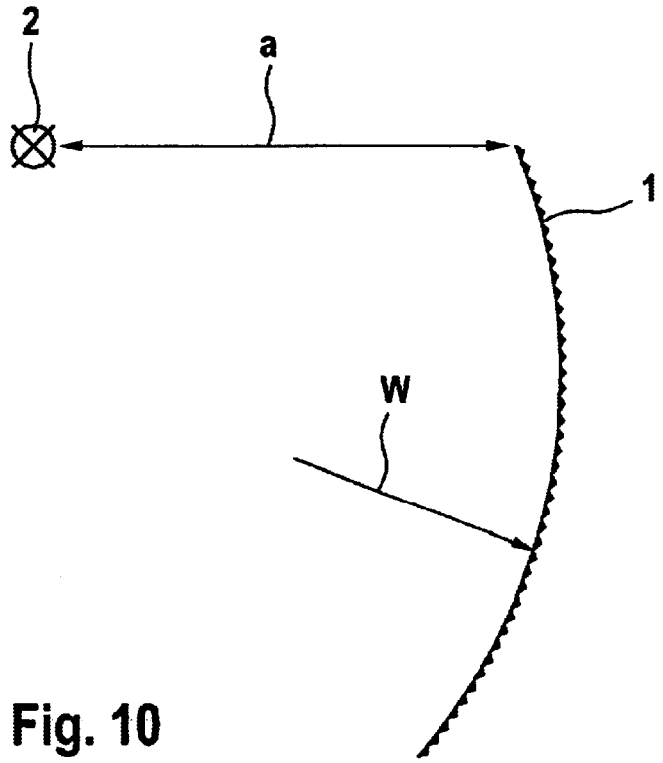

FIG. 10 shows the curved arrangement of the prism foil 1 relative to the illuminant body 2 in which the curvature of the prism foil 1 is formed by adjoining circular segments as described supra in connection with FIG. 9. The ratio of the spacing a of the illuminant bodies 2 from the prism foil 1 to the respective radius of curvature W is identical in each area of the prism foil 1. An optimal anti-glare effect of the illuminant body 2 by eliminating individual beam bundles by way of total reflection on one lateral side surface of the prisms is realized for a curvature of the prism foil 1 such that in each area of the prism foil 1 the spacing a of the illuminant body 2 is smaller than the radius of curvature W of the prism foil 1.

Figure 11:
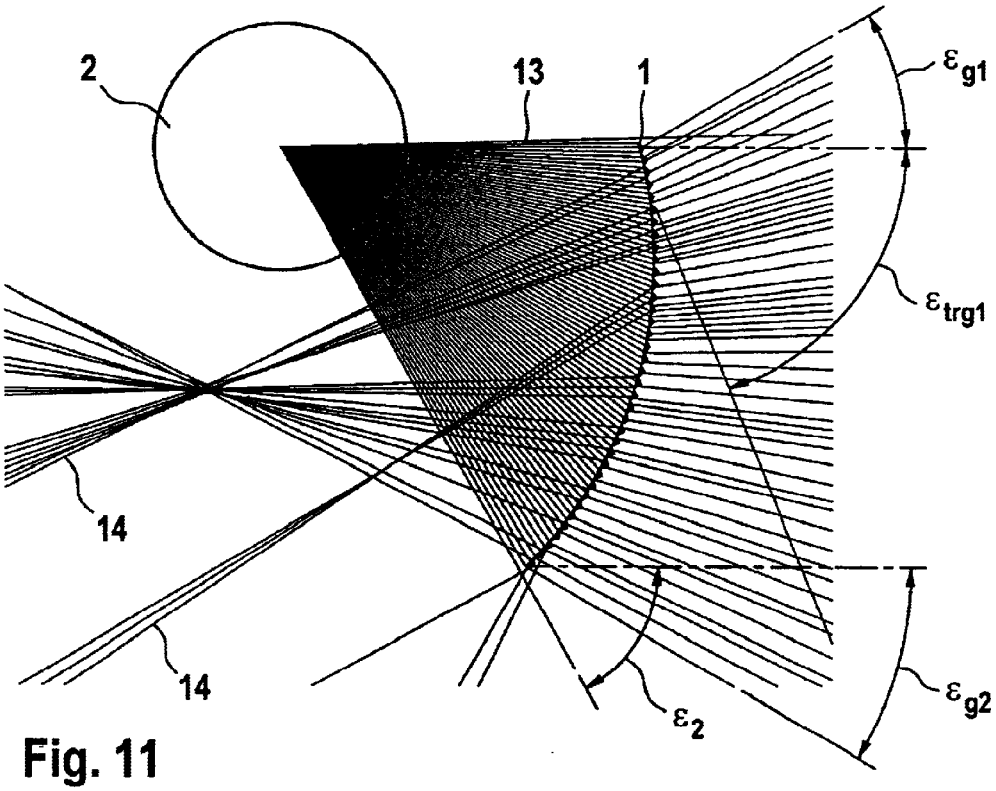
FIGS. 11 and 12 cross-sections of the illuminant body and the beam paths of the light beams impinging on the prism foil.

The beam paths for a curvature contour similar to FIG. 10 is illustrated in FIG. 11. The prism foil 1 covers in the illustrated detail view a radiating sector of the illuminant body 2 with an angle of incidence of the radially emitted light beams 13 of approximately $\epsilon_2$=60°. The angle range of the reflected light beams, which are deflected on the prismatic surface of the foil 1 opposite the illuminant body 2 into the room to the illuminated, are within an angle range of approximately the same magnitude as the angle of incidence $\epsilon_2$ wherein, however, the radiation of the refracted light beams in the radiating area $\epsilon_{g1}=\epsilon_{g2}$ is displaced relative to the horizontal. The refracted beams in the radiating area of the illuminant body 2 from $\epsilon_1$ to $\epsilon_2$ are deflected into the angle ranges of the limit angles $\epsilon_{g1}$ and $\epsilon_{g2}$ relative to the horizontal, respectively. In the present embodiment the following applies: $\epsilon_{g1}$=30° and $\epsilon_{g2}$=−30° and, accordingly, $|\Delta\epsilon|=(\epsilon_{g1}-\epsilon_{g2})=60°=\epsilon_2$. The radiating area of the illuminant body 2 of ±60° is deflected into an angle range of ±30°.

By means of the described curvature of the prism foil 1, the total-reflected light beams 14 are reflected back into a space away from the illuminant body 2 behind the foil 1 so that a further anti-glare effect of the lamp 2 is realized. Moreover, partial beams of the total-reflected light beams 14 can be radiated by means of refraction on the other lateral side surface of the prisms in an angle range $\epsilon_{trg1}$ as scattered light on the side of the prism foil remote from the illuminant body 2 into the room to be illuminated. Light beams with different orientations are therefore radiated into the room to be illuminated with beneficial scattering action. Such an arrangement of the prisms can advantageously be obtained by a mirror-symmetrical curvature of the prism foil as illustrated in FIG. 2.

The luminosity of the prism foil is homogenous across the entire foil surface wherein similar luminance can be observed from any viewing angle onto the prism foil. The scattered light is visible but does not cause glare.

Figure 12:
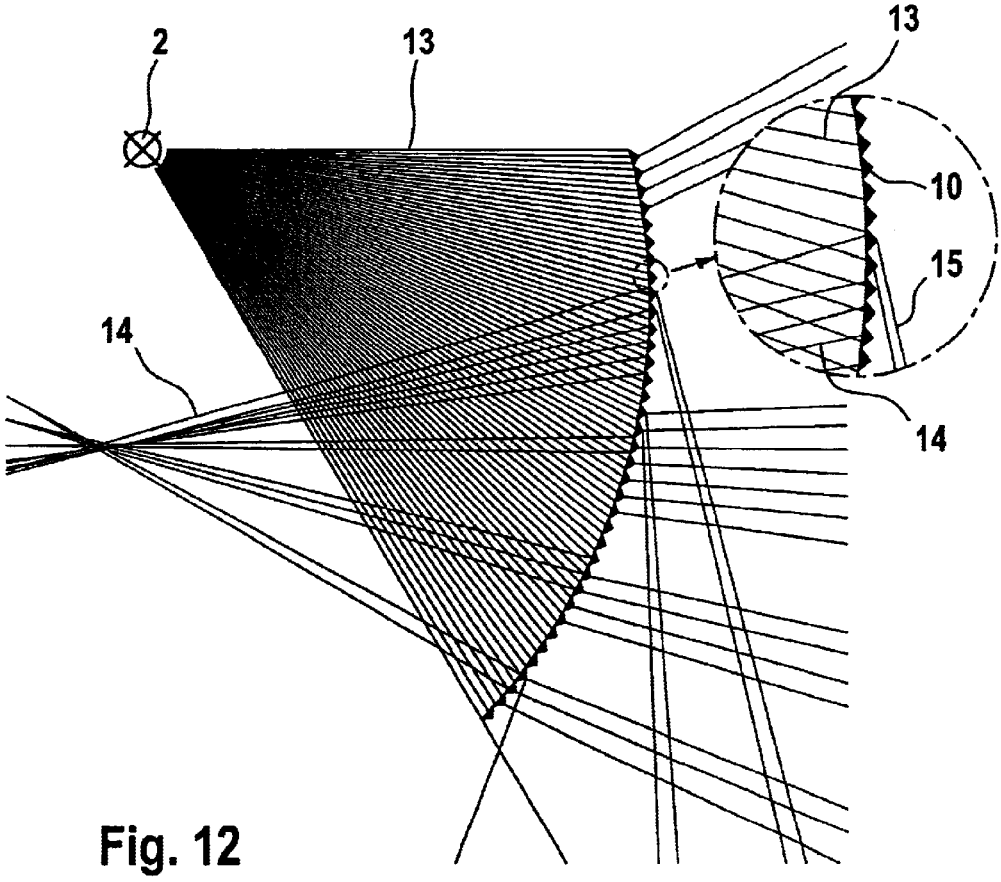

FIG. 12 shows the arrangement of a prism foil with the curvature contour already illustrated in FIG. 7. In this context, the desired light distribution is achieved by means of right-angle, isosceles prisms and a ratio of the spacing between the illuminant body 2 and the prism foil to the radius of curvature W of approximately 0.33. This ratio is expediently smaller than three wherein the spacing/curvature ratios which are smaller than one have been found to be particularly advantageous.

As illustrated in the enlarged portion of the area of the prism foil encircled by a dashed line, a large portion of the total-reflected light beams 14 are reflected back onto the side of the prism foil facing the illuminant body 2 wherein, however, individual light beams exit through the lateral side surfaces of the individual prisms 10 such that they impinge on the lateral side surfaces of the adjoining prism. These transverse beams exit after several refractions on several prisms as scattered light 15 wherein additional beam directions of the light radiated by the prism foil 1 are generated. The light diffusion with a plurality of beam directions results in a uniform brightness pleasant to the eye so that an increased sense of comfort is provided to the persons within the illuminated room.

What is claimed is:

1. An anti-dazzling transparent screen for an elongate light source (2) covering the light source (2) over a length thereof for providing an anti-dazzling effect of a radiating sector ($\alpha$) of the light source (2), the anti-dazzling transparent screen comprising:

a surface formed of elongate prisms (10) extending approximately parallel to one another and aligned substantially in a longitudinal direction of the light source (2);

wherein the prisms (10) each have a first lateral side surface and a second lateral side surface and base surface;

wherein the prisms (10) are positioned relative to the light source (2) such that the base surfaces face the light source and the light beams (13) radiating from the light source (2) directly enter the prisms (10) through the base surface;

wherein the prisms are oriented relative to the light source such that the light beams that directly impinge on the first lateral side surfaces after entering through the base surfaces are total-reflected on the first lateral side surfaces (11, 12) and propagate as total-reflected light beams and the light beams that directly impinge on the second lateral side surfaces after entering through the base surfaces pass through the second lateral side surfaces.

2. The anti-dazzling transparent screen according to claim 1, wherein the transparent screen (1) has a first side facing the light source (2) and wherein the first side is comprised of the base surfaces (8) of the prisms (10) and the base surfaces are plane.

3. The anti-dazzling transparent screen according to claim 2, wherein the prisms (10) have a triangular cross-section having a base, wherein the base of the triangular cross-section forms the plane base surface (8) of the prisms (10), respectively.

4. The anti-dazzling transparent screen according to claim 3, wherein the triangular cross-section of the prisms (10) has a shape of an isosceles triangle.

5. The anti-dazzling transparent screen according to claim 2, wherein the plane base surfaces (8) of the prisms (10) are positioned at an angle deviating from 90° relative to the light beams (13) impinging on the prisms (10).

6. The anti-dazzling transparent screen according to claim 1, wherein the total-reflected light beams travel on such beam paths in the prisms (10) that the total-reflected light beams are deflected at least partially at a spacing past the light source (2).

7. An anti-dazzling transparent screen for an elongate illuminant body (2) covering the illuminant body (2) over a length thereof for providing an anti-dazzling effect of a radiating sector ($\alpha$) of the illuminant body (2), the anti-dazzling transparent screen comprising:

a surface formed of elongate prisms (10) extending approximately parallel to one another and aligned substantially in a longitudinal direction of the illuminant body (2);

wherein the prisms (10) have lateral side surfaces (11, 12), respectively;

wherein the prisms (10) are positioned relative to the illuminant body (2) such that on at least one of the lateral side surfaces (11, 12) light beams (13), radiating from the illuminant body (2) and having entered the prisms (10) and impinging on the at least one of the lateral side surfaces (11, 12), are total-reflected and propagate as total-reflected light beams;

wherein the transparent screen (1) has a first side facing the illuminant body (2); wherein the prisms have a plane base surface (8), respectively, and wherein the first side is comprised of the plane base surfaces (8) of the prisms (10);

wherein the transparent screen is comprised of a prism film (1) having a prismatic surface on one side of the prism film (1);

wherein the prism film (1) is curved about the illuminant body (2).

8. The anti-dazzling transparent screen according to claim 7, wherein the prism film (1) is arranged such that on one of the lateral side surface (11, 12) of the prisms (10) the light beams (13) are total-reflected, respectively.

9. An anti-dazzling transparent screen for an elongate illuminant body (2) covering the illuminant body (2) over a length thereof for providing an anti-dazzling effect of a radiating sector ($\alpha$) of the illuminant body (2), the anti-dazzling transparent screen comprising:

a surface formed of elongate prism (10) extending approximately parallel to one another and aligned substantially in a longitudinal direction of the illuminant body (2);

wherein the prisms (10) have lateral side surfaces (11, 12), respectively;

wherein the prisms (10) are positioned relative to the illuminant body (2) such that on at least one of the lateral side surfaces (11, 12) light beams (13), radiating from the illuminant body (2) and having entered the prisms (10) and impinging on the at least one of the lateral side surfaces (11, 12), are total-reflected and propagate as total reflected light beams;

wherein the transparent screen (1) has a first side facing the illuminant body (2); wherein the prisms have a plane base surface (8), respectively, and wherein the first side is comprised of the plane base surfaces (8) of the prisms (10);

wherein the transparent screen is comprised of a prism film (1) having a prismatic surface on one side of the prism film (1);

wherein the prism film (1) has such a radius of curvature (W) that in any area of the prism film (1) a spacing (a) of the illuminant body (2) from the prism film (1) is smaller than the radius of curvature (W).

10. The anti-dazzling transparent screen according to claim 9, wherein a ratio of the spacing (a) of the illuminant body (2) from the prism film (1) to the radius of curvature (W) is substantially identical in any area of the prism film (1).

11. An anti-dazzling transparent screen for an elongate illuminant body (2) covering the illuminant body (2) over a length thereof for providing an anti-dazzling effect of a radiating sector ($\alpha$) of the illuminant body (2), the anti-dazzling transparent screen comprising:

a surface formed of elongate prisms (10) extending approximately parallel to one another and aligned substantially in a longitudinal direction of the illuminant body (2);

wherein the prisms (10) have lateral side surfaces (11, 12), respectively;

wherein the prisms (10) are positioned relative to the illuminant body (2) such that on at least one of the lateral side surfaces (11, 12) light beams (13), radiating from the illuminant body (2) and having entered the prisms (10) and impinging on the at least one of the lateral side surfaces (11, 12), are total-reflected and propagate as total-reflected light beams;

wherein the transparent screen (1) has a first side facing the illuminant body (2); wherein the prisms have a plane base surface (8), respectively, and wherein the first side is comprised of the plane base surfaces (8) of the prisms (10);

wherein the transparent screen is comprised of a prism film (1) having a prismatic surface on one side of the prism film (1);

wherein the illuminant body (2) is received in a housing (3) having opposed end faces (4) in a longitudinal direction of the housing (3), wherein the end faces (4) have a curved edge (5) having a contour corresponding to a desired contour of the prism film (1), wherein the prism film (1) rests against the curved edge (5), respectively.

* * * * *